US005836224A

United States Patent [19]

Gerber

[11] Patent Number: 5,836,224

[45] Date of Patent: Nov. 17, 1998

[54] METHOD AND APPARATUS FOR WORKING ON SHEET MATERIAL

[75] Inventor: Heinz Joseph Gerber, West Hartford, Conn.

[73] Assignee: Gerber Garment Technology, Inc., Tolland, Conn.

[21] Appl. No.: 579,336

[22] Filed: Dec. 27, 1995

[51] Int. Cl.[6] ..... B26D 7/14; D06H 7/00

[52] U.S. Cl. ..... 83/22; 83/76.6; 83/169; 83/175; 83/451; 83/941

[58] Field of Search ..... 83/22, 24, 941, 83/98, 99, 100, 175, 176, 451, 76.1, 76.6, 169

[56] References Cited

U.S. PATENT DOCUMENTS

| | | | |
|---|---|---|---|
| 3,346,954 | 10/1967 | Ulrich | 83/98 |
| 3,750,507 | 8/1973 | Gerber et al. | 83/169 |
| 3,841,187 | 10/1974 | Gerber et al. | 83/941 |
| 3,848,327 | 11/1974 | Gerber et al. | 83/22 |
| 3,877,334 | 4/1975 | Gerber | 83/22 |
| 4,091,701 | 5/1978 | Pearl | 83/747 |
| 4,140,037 | 2/1979 | Gerber | 83/941 |
| 4,200,015 | 4/1980 | Gerber | 83/941 |
| 4,646,911 | 3/1987 | Pearl et al. | 198/689.1 |
| 4,685,363 | 8/1987 | Gerber | 83/22 |
| 5,189,936 | 3/1993 | Gerber et al. | 83/409 |
| 5,289,749 | 3/1994 | Imai et al. | 83/941 X |

*Primary Examiner*—M. Rachuba
*Assistant Examiner*—Charles Goodman
*Attorney, Agent, or Firm*—McCormick, Paulding & Huber

[57] ABSTRACT

An automatically controlled cutting machine for working on limp sheet material utilizes positive air pressure and vacuum to hold the material in place during a work operation. The level of the pressure is set or regulated with a pressure sensor to develop an appropriate holddown force and to minimize the disturbance to the material surrounding the work operation. The distribution of the airflow onto the sheet material for generating the pressure is also concentrated around the point of the work operation by an aperture plate.

6 Claims, 3 Drawing Sheets

METHOD AND APPARATUS FOR WORKING ON SHEET MATERIAL

BACKGROUND OF THE INVENTION

The present invention relates to a method and apparatus for working on the sheet material, particularly limp sheet material such as cloth, paper, plastic and the like which is held in a spread condition while it is worked on by a tool such as a cutting blade, drill or other tool.

In the prior art, it is well known to spread cloth and other limp sheet materials on a support surface for cutting, drilling and other operations. In the garment industry it is known to spread cloth in single or multiple plies on a cutting table having an air-permeable bed, and to cut pattern pieces from the material by means of cutting blades, lasers, water jets and other types of tools. The pattern pieces are then assembled in garments or other finished articles.

U.S. Pat. Nos. 4,646,911 and 5,189,936 illustrate conveyorized vacuum tables formed with bristle beds for loading sheet material onto the bed, holding the material in a compressed and stationary position under vacuum during cutting and unloading the cut material after the cutting operation is completed on one or more segments or "bites" of the sheet material. When the material is held in place by vacuum, a plastic or other air-impermeable overlay is frequently placed on the material to develop compression forces for compacting the material in addition to holding the material in position.

U.S. Pat. Nos. 3,750,507; 3,848,327 and 3,877,334 all disclose apparatus for cutting sheet material that is held in a spread condition on a cutting table by means of pressure developed by air discharged onto the material from compartments overlying the material. The combination of air pressure on top of the material and vacuum drawn from below is disclosed in the latter two patents.

While each of the above-referenced patents is concerned with a cutting machine that cuts a large number of plies of sheet material in a single operation, there is also demand for machines which cut single or a limited number of plies for the manufacture of garments and other products. In such machines, the problem of holding the material during a cutting operation is approached somewhat differently because of the limited numbers of plies that are cut. The spreading of an air-impermeable overlay that is destroyed in the course of cutting the sheet material can be eliminated provided that there is an adequate pressure differential to hold the few plies of material in position. By eliminating the overlay, the time and expense of the cutting operation is reduced.

The use of positive air pressure to hold sheet material in position during cutting as disclosed in the above referenced patents can cause cut edges of the sheet material to be disturbed or lifted due to the air which is generally discharged from a compartment structure immediately above the sheet material and flows laterally over the sheet material at a relatively high velocity. The lateral flow of air and resulting disturbances of the cut material are undesirable and lead to inaccuracies in the pattern pieces that are cut. U.S. Pat. No. 3,750,507 discloses a pressurizing system with vents for directing the escaping air upwardly away from the sheet material in order to reduce the shifting or other disturbance of the material.

When a pressurized holddown system which discharges air onto the sheet material is combined with a vacuum system, the vacuum system will tend to absorb some of the air escaping from the perimeter of the pressurizing compartments and reduce the lifting or other disturbance of the sheet material as disclosed in U.S. Pat. No. 3,848,327.

Nonetheless, when cutting single or low plies of sheet material with positive air pressure pressing downward on the material with or without vacuum drawing the material onto the support surface, it is desirable to minimize the amount of escaping air and any associated disturbance of the surrounding material.

It is, accordingly, a general object of the present invention to provide a method and apparatus for holding sheet material during a work operation with minimal disturbing forces to the material itself.

It is a further object of the present invention to provide a method and apparatus utilizing positive pressure to develop holddown forces without generating the disturbing forces due to air flowing horizontally over the material.

SUMMARY OF THE INVENTION

The present invention resides in a method and apparatus for working on sheet material, particularly limp sheet material, and holding that material in place during the work operation.

An apparatus which carries out the method includes means providing a horizontal support surface for supporting at least one layer of sheet material in a spread condition for the work operation. A tool for working on the sheet material is moveable relative to the support surface and material thereon in a plane generally parallel to the support surface to accomplish the work operations. For example, the tool may be a reciprocating knife blade, a drill, a laser or a water jet for cutting the material on the support surface.

Airflow means discharges air onto the sheet material to hold the material in place on the support surface. The airflow means may include a compartment that surrounds the tool so that the material in the vicinity of the tool is properly held during the tool operation.

Sensing means detect holddown forces with which the air-flow means holds the sheet material on the support surface. For example, the air may be discharged onto the sheet material from a compartment structure suspended over the material, and the sensing means may be a pressure sensor mounted on the compartment to detect the air pressure at the surface of the material.

Control means are connected with the sensing means for controlling the holddown force in response to the detected forces. The control means may regulate the device supplying the air to the airflow means so that the holddown force is maintained at an adequate level and the flow of air escaping from the compartment structure discharging the air is reduced to atmospheric pressure. In this manner, the disturbance of the surrounding material by the escaping air is minimized or eliminated.

Alternatively, the pressure sensor can be omitted, and instead, the control means may be set manually, or a look-up table containing various working conditions and optimum pressures of the air supplying device can be employed to set the air pressure.

In one form, the compartment structure from which the pressurized air is discharged surrounds the tool or cutting blade, and an aperture plate having a central opening for the tool is provided with a plurality of discharge apertures concentrated around the central opening. The discharged air is diffused when it reaches the perimeter of the structure and correspondingly has a lower velocity and lower tendency to disturb the sheet material.

DESCRIPTION OF THE PREFERRED EMBODIMENTS

Figure 1:
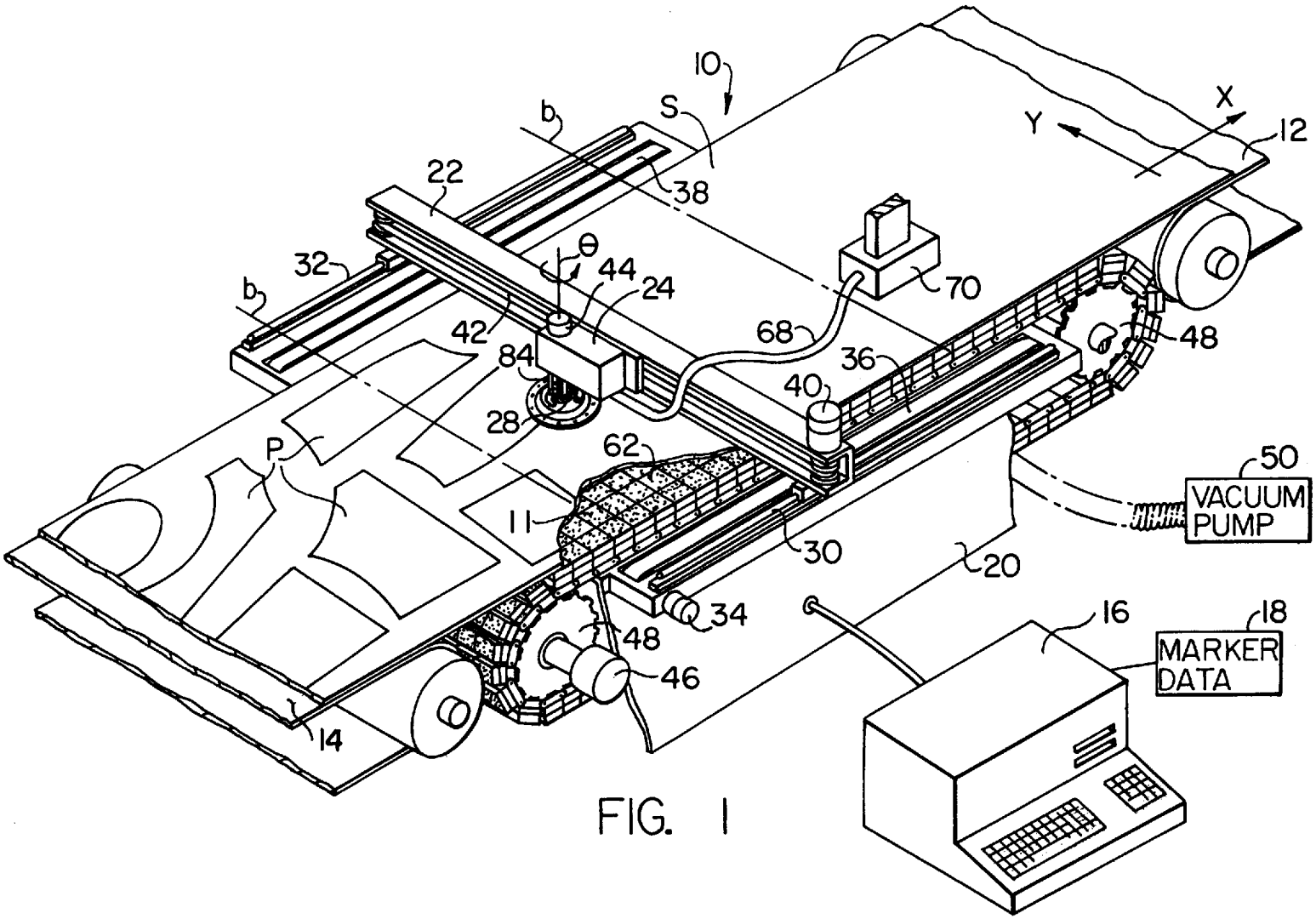
FIG. 1 is a perspective view of a cutting machine for cutting pattern pieces from a single ply of sheet material in accordance with the present invention.

FIG. 1 illustrates a numerically controlled cutting machine, generally designated 10, for cutting pattern pieces in accordance with the present invention from a length of sheet material S that is spread over a cutting table 11 in single or multiple plies. The invention has particular utility for cutting a single ply or a few plies of sheet material in contrast to cutting layups consisting of 20 or more plies of material. As illustrated, the cutting machine cuts a plurality of closely nested pattern pieces P in an array referred to in the garment industry as a marker. However, the invention described hereinafter is not limited to the garment industry and may be used in a wide range of work operations on sheet material which is drilled or cut by many different types of tools including reciprocating cutting blades, ultrasonic knives, rotatable knives and drills, laser beams or water jets.

The cutting table 11 of the cutting machine 10 is a conveyor table. The sheet material S is loaded onto the cutting table 11 from a spreading and loading conveyor 12 and cut by the cutting machine 10 on the cutting table 11. The cut pattern pieces together with the surrounding material are then unloaded from the cutting table by means of an unloading conveyor 14. Eventually the cut pattern pieces P are removed from the unloading conveyor and are transported to a sewing room for assembly into a garment.

The length of the marker or array of pattern pieces that is cut from the sheet material S may be substantially larger than the cutting machine itself. Under such circumstances the material is moved in segments or "bites" onto the cutting table 11 for cutting all of those pattern pieces P in the one segment of the marker while the material is stationary on the cutting table 11. Thereafter, the next segment is moved onto the cutting table, and the previously-cut pieces are drawn onto the unloading conveyor 14. The sequence of alternately feeding and cutting the material is established by a control computer 16 to which the marker data 18 is supplied and continues until the entire marker has been cut.

The cutting machine 10 includes an X-drive carriage 22 which is moveable back and forth relative to the base 20 in the illustrated X-coordinate direction, and a Y-carriage 24 which is mounted on the X-carriage 22 for movement therewith and is moveable relative to the X-carriage back and forth relative to the base in the illustrated Y-coordinate direction. A cutting tool in the form of a reciprocating cutting blade 28 is suspended from the Y-carriage 24 and can be moved up or down relative to the carriage to be brought into and out of cutting engagement with the sheet material S. The cutting blade is also rotatable about the θ-axis in order to be oriented generally tangentially of the cutting paths defined by the peripheries of the pattern pieces P.

The X-carriage 22 rides on stationary roundways 30 and 32 at opposite sides of the cutting table 11 and is driven back and forth in the illustrated X-coordinate direction by means of an X-drive motor 34 and a pair of drive belts 36, 38 coupled to the carriage 22 at each side of the table. The Y-carriage 24 is moved back and forth on the X-carriage relative to the sheet material in the illustrated Y-coordinate direction by means of a servomotor 40 and a drive belt 42 trained over pulleys at opposite ends of the X-carriage.

The rotation of the cutting blade 28 about the θ-axis is accomplished by the θ-servomotor 44 mounted on the Y-carriage 24. In addition, the cutting blade is lifted from or plunged into cutting relationship with the sheet material by means of a servomotor not shown.

Collectively the X-servomotor 34, the Y-servomotor 40 and the θ-servomotor 44 cooperate to move the cutting blade 28 in cutting engagement with the sheet material at the periphery of the pattern pieces in response to commands transmitted to the motors from the control computer 16 in response to the marker data 18. Additionally, the computer 16 controls the bite feeding of the sheet material onto and off of the cutting table 11 as well as the operation of the loading and unloading conveyors 12 and 14.

As indicated above, the cutting table 11 is a conveyor table on which the sheet material S is loaded from the loading conveyor 12, then cut by the cutting blade 28 and then discharged onto the unloading conveyor 14. While the segment of material S on the table between the dashed lines b is being cut, the cutting table 11 and the material remain stationary with respect to the base 20. Thus, the cutting blade 28 performs all of the cutting motions.

Figure 2:
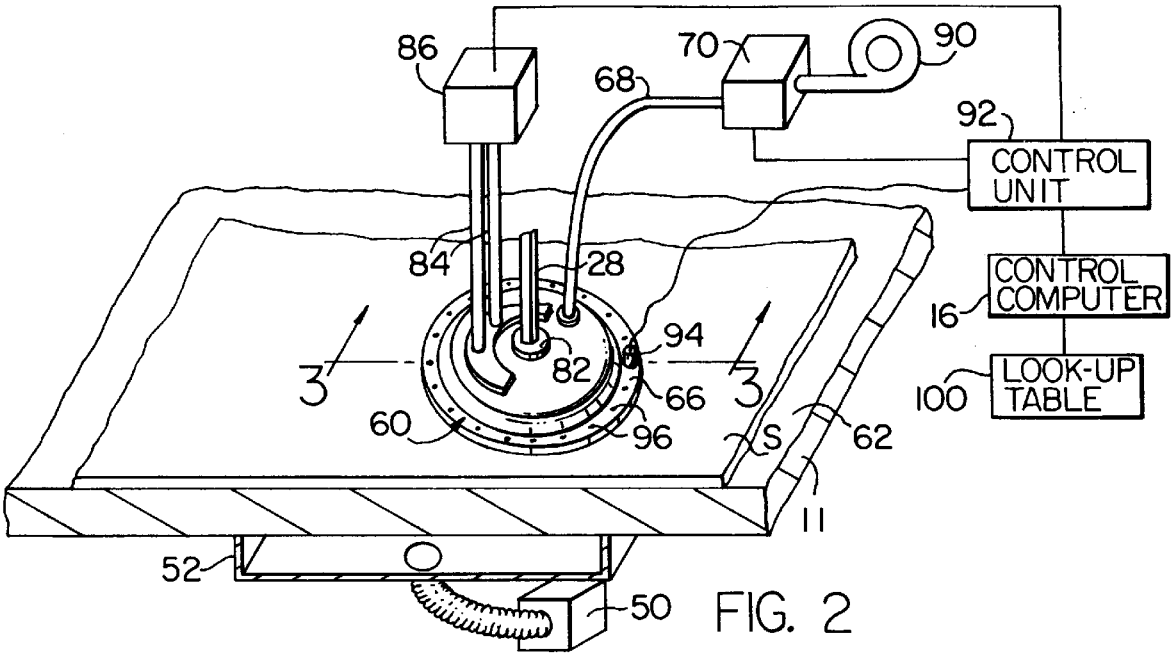
FIG. 2 is a fragmentary perspective view of the cutting machine showing the cutting head, the compartment for discharging air and pressing the sheet material onto the support surface of an air permeable bed and a vacuum system for holding the sheet material on the bed.
Figure 3:
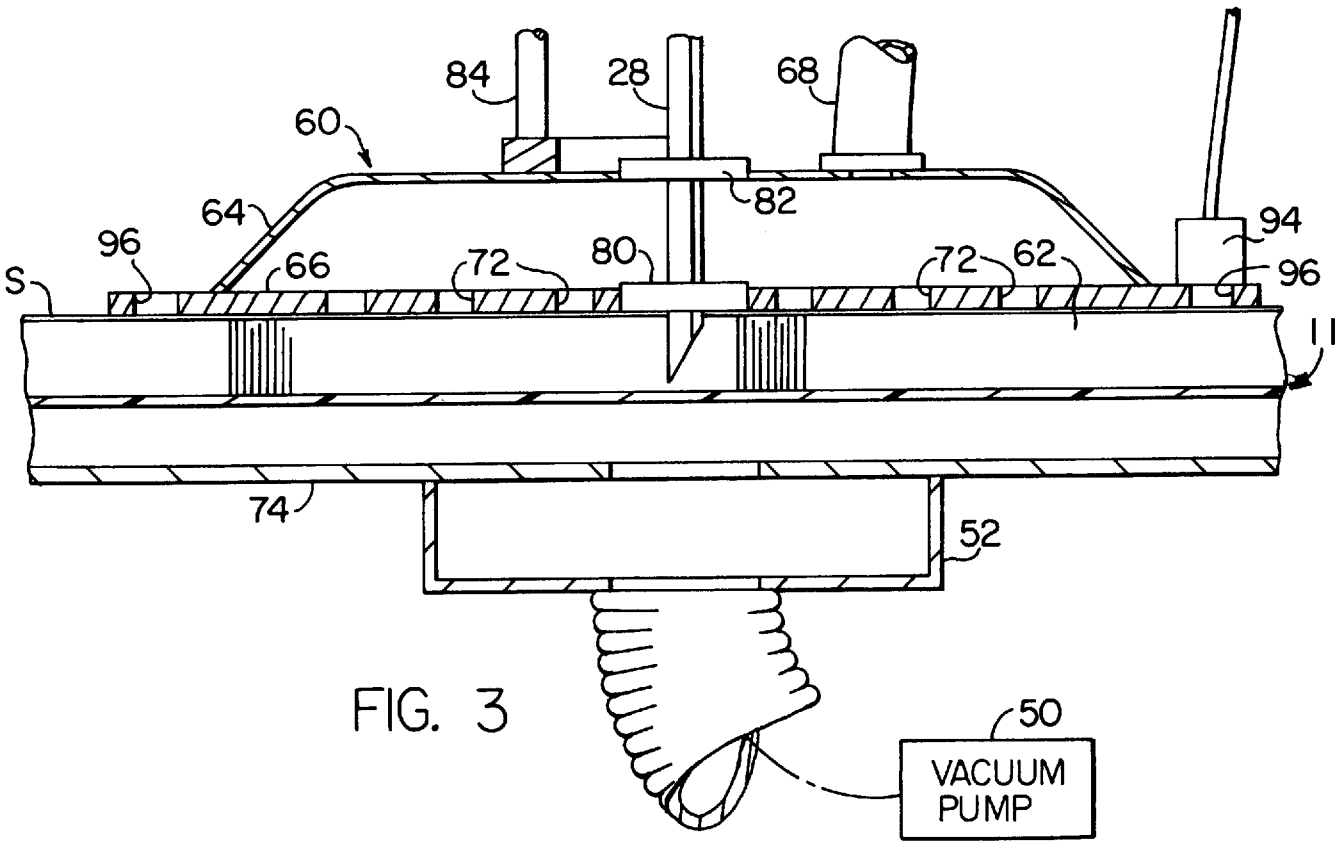
FIG. 3 is a cross-sectional view of the compartment, bed and vacuum system in FIG. 2 as seen along the sectioning line 3—3.

To accommodate the cutting blade, the cutting table 11 as shown in FIGS. 2 and 3 is formed by a penetrable bed 62 of bristle blocks whose bristles project upwardly into a plane defining the support surface of the table. The bristle blocks are arranged in rows extending in the Y-coordinate direction with each row being supported in a channel-shaped slat 74 and each slat being linked to the adjacent slats to form a conveyor that can be driven in the illustrated X-coordinate direction by the drive motor 46 and drive sprockets 48 in FIG. 1.

The bristle blocks have perforate bases or are spaced slightly from one another for air permeability and are coupled through each of the supporting slats 74 and a manifold 52 to a vacuum pump 50 that evacuates the region of the bristles and the associated support surface of the table 11 at least in the vicinity of the cutting blade 28, if the table is provided with vacuum zoning. By drawing a vacuum at the support surface through the air permeable bristle bed, the overlying sheet material is drawn toward the support surface of the bristles and held firmly in position during cutting. For further details concerning the construction and operation of such a table, reference may be had to U.S. Pat. Nos. 4,646,911 or 5,189,936.

Alternatively, the penetrable bed 62 may be constructed with a bristle bed connected with manifolds along the lateral edges of the bed to evacuate the supported sheet material and the bristle region by drawing air laterally through the bristles. Still further, the bed may be formed by other penetrable materials such as foamed plastic with drilled holes or an open cell structure for evacuation.

As shown in more detail in FIGS. 2 and 3, an airflow device is formed by a compartment 60 surrounding the cutting blade 28. Pressurized air flows downwardly from the compartment onto the sheet material S in order to press the sheet material against the support surface of the cutting table 11 formed by the bristle bed 62. As shown in FIG. 3, the compartment 60 includes an upper shell 64 having an opening at the bottom side which is closed by an apertured pressure plate 66. The shell has a generally cylindrical shape and the aperture plate is circular and covers the bottom of the shell.

Figure 4:
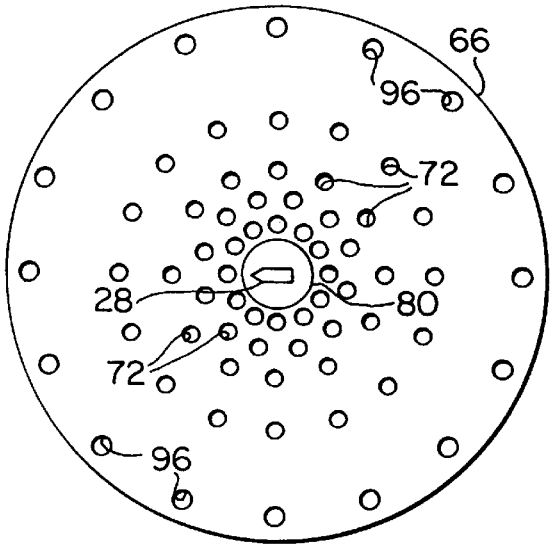
FIG. 4 is a bottom plan view of the compartment shown in FIG. 2.

Air at a relatively low pressure flows into the compartment 60 through a flexible hose 68 from a regulated air supply 70 shown in FIGS. 1 and 2. As shown in FIGS. 3 and 4, the compartment 60 serves as a plenum and the air passes from the plenum downwardly onto the sheet material through a plurality of apertures 72 in the pressure plate 66. As air is discharged from the downwardly facing surface of the plate onto the upwardly facing surface of the sheet material S, the air develops a pressure to hold the material firmly in position on top of the bristle bed 62. The bristle bed and the series of transversely extending slats 74 are evacuated through the longitudinally extending manifold 52 and, thus, at least a portion of the air discharged from the compartment 60 onto the sheet material is drawn downwardly through cuts in the sheet material, and through the sheet material itself if it is air permeable, into the bristle bed 62.

Accordingly, the discharging of air from the apertures 72 and the drawing of the discharged air through the sheet material into the bristle bed 62 have a cooperative and cumulative effect which presses the sheet material firmly against the support surface of the cutting table 11 to hold the material in place. The cooperative effect also allows the size of the vacuum system connected with the bed to be smaller than would otherwise be needed. The economics of the system are advanced with a smaller vacuum system as well as the potential for eliminating an air permeable overlay in each cutting operation.

FIG. 4 shows the bottom side of the pressure plate 66 and clearly illustrates one embodiment of the pressure plate in which the apertures 72 are concentrated around the cutting blade 28 at the center of the plate. The cutting blade as shown in FIGS. 3 and 4 passes through a blade guide 80, which may be of the type shown in U.S. Pat. No. 4,091,701, that is mounted in a central opening in the plate 66 and allows the blade to reciprocate and rotate with respect to the pressure plate. A similar blade guide 82 in combination with a seal is provided where the cutting blade 28 passes through the center of the shell 64 as shown in FIG. 3. The seal is not essential but will minimize the amount of pressurized air leaking out of the compartment 60.

The compartment 60 is suspended from the Y-carriage 24 as shown in FIG. 1 by means of a pair of support rods 84 and a pressure control actuator 86 shown in FIG. 2. The actuator may be a hydraulic, pneumatic or electrical actuator that raises and lowers the compartment 60 as well as applies a downward force on the compartment corresponding to a desired pressure or force developed on the sheet material S by the discharged air. Alternatively, a spring or other resilient member may be substituted for the actuator 86, and the force applied to the sheet material under such circumstances will be governed entirely by the pressure of the air discharged from the pressure plate 66.

In one embodiment of the invention the air supply 70 as shown in FIG. 2 is regulated in order to control the pressure of the air supplied to the compartment 60, as well as the pressure of the air discharged through the pressure plate 66. Air from a low pressure air pump 90 or high pressure air from a shop compressor is delivered to the air supply 70, and the pressure of the air delivered by the supply 70 is regulated in accordance with a signal received from a control unit 92. The control unit 92 may be connected with the main control computer 16 in FIG. 1 so that the pressure generated by the compartment 60 can be correlated with the conditions governing the cutting of the sheet material S. Since regulation of the pressure from the air supply 70 affects the air pressure developed by the air compartment 60 and the force applied to the sheet material, the control unit 92 is also connected with the pressure control actuator 86 to assure consistency between the force applied by the actuator and the holddown force developed by the discharging air.

The regulation of the air pressure can be performed by an open loop central system based upon a desired air pressure at the output of the air supply 70. However, precise control over the holddown force on the sheet material is obtained when the pressure on the material is detected and the control unit 92 regulates the air supply and the pressure control actuator 86 in accordance with the detected pressure. For this purpose a pressure sensor 94 is mounted in an aperture 96 at the perimeter of the pressure plate 66 to detect the air pressure operating on the sheet material S as a result of the air discharged onto the material through the apertures 72 near the center of the plate.

With the distribution of apertures 72 shown in FIG. 4, one portion of the air discharged through the plate may be drawn downwardly through the sheet material into the bristle bed 62, and another portion of the air may flow horizontally over the upper surface of the sheet material toward the perimeter of the plate 66. If the horizontal flow of air is significant, the air may escape from the perimeter of the plate 66 and tend to lift cut edges of pattern pieces resting adjacent the compartment 60. Such lifting and disturbance of the sheet material is undesirable. Ideally, sufficient pressure should be generated on the sheet material by the discharged air to hold the material down on the bed 62 in the region of the apertures 72 surrounding the blade 28, and the horizontal flow of air should be dissipated as much as possible prior to reaching the perimeter of the compartment. Both objectives are promoted as a result of the radial diffusion of the horizontal flow of air under the plate 66 and the absorption of the air by the penetrable bed 62 under vacuum. Under such conditions a pressure close to atmospheric pressure prevails at the pressure sensor 94, and the sensor sends a sensor signal back to the control unit 92 to maintain the flow of air delivered from the air supply 70 at the pressure level that sustains atmospheric pressure at or near the perimeter of the pressure plate. Naturally, variations in material and the number of cuts which underlie the pressure plate 66 affect the pressure at the output of the air supply 70 which provides the desired pressure and flow conditions at the perimeter.

The controlled air flow between the upper surface of the sheet material S and the pressure plate 66 has an added benefit in that an air bearing is formed under the air compartment 60 surrounding the cutting blade 28. The pressure producing compartment 60 is insured at least a minimum cushion of air under the plate 66 as long as the pressure of the air discharged at the apertures 72 does not drop to atmospheric pressure before the air reaches the periphery of the plate.

The pressure sensor 94 may also be located to detect the pressure under the plate 66 at stations other than the perimeter in order to control the holddown force at a desired level.

The flow of the discharged air in the horizontal direction at the perimeter of the pressure plate 66 is also reduced by virtue of a plurality of apertures 96 which serve as vents. If the discharged air has not reached atmospheric pressure by the time the air arrives at the perimeter, the apertures 96 vent the air upwardly away from the sheet material and in this fashion prevent the air from disturbing adjacent, previously cut pieces of the material.

The air supply system can be operated in several different modes in open-loop fashion without the sensor 94. If the machine operator is an experienced person and knows what the air pressure and holdown force should be for a particular cutting operation, he can manually enter the desired air pressure and force directly into the control computer 16, and the control computer feeds a desired air pressure signal to the control unit 92 and a desired force signal to the actuator 86 in FIG. 2. Alternatively, a series of tests can be performed under various cutting conditions and parameters to determine the optimum air pressure and corresponding force that should be applied to the sheet material in each instance. The conditions varied include the type of material that is being cut, the depth or number of plies of material on the support surface 62, whether or not the vacuum system will be turned on, and other conditions that affect the level of pressure to be used and correspondingly the force to be imposed on the sheet material by the air compartment 60. The optimum pressures and corresponding cutting conditions are then stored as data in a look-up table 100 connected with the control computer as shown in FIG. 2 so that an inexperienced operator need only load the various parameters that define a cutting operation into the control computer 16, and the computer together with the lookup table 100 automatically sets the air pressure produced by the air supply 70 and the downward force generated by the actuator 86.

While the present invention has been described in several embodiments, it should be understood that numerous modifications and substitutions can be employed without departing form the spirit of the invention. For example, although the air supply system including the regulated air supply 70 and the pressure sensor 94 is employed with a cutting table 11 having a vacuum system for drawing some of the air downwardly into the air permeable bed 62, the air supply system can also be used with other types of cutting tables that do not include a vacuum system. While the cutting table described above is a conveyor table, the invention can be used as well with a stationary cutting table having a non-movable bed. The air supply system can also be used with other types of tools which perform operations on the sheet material S. Other types of sensors than pressure sensors may be used to detect airflow at the periphery of the compartment 60, and the compartment itself can assume various configurations as disclosed, for example, in U.S. Pat. No. 3,848,327. Accordingly, the present invention has been described in a preferred embodiment by way of illustration rather than limitation.

We claim:

1. A method of working on sheet material comprising:

providing a support surface for supporting at least one layer of limp sheet material in a spread condition;

placing a work tool in working relationship with the material in a work operation while the material is spread on the support surface;

identifying present working condition parameters which include type of sheet material, depth of sheet material or number of plies of sheet material;

inputting the present working condition parameters into a control system which includes a look-up table storing a plurality of predetermined pressure level values and associated working condition parameters, each value representing a suitable level of pressure for securely holding sheet material to the support surface under the associated working condition parameters;

matching the present working condition parameters with stored working condition parameters to select a pressure level value which represents a suitable level of pressure for the present working condition parameters;

retrieving the selected pressure level value, and discharging a pressurized gas at the selected level of pressure against the sheet material for securely holding the sheet material to the support surface.

2. A method of working on sheet material as defined in claim 1, wherein the step of inputting is performed manually.

3. A method of working on sheet material as defined in claim 1, wherein the pressurized gas is pressurized air.

4. A method of working on sheet material comprising:

providing a support surface for supporting at least one layer of limp sheet material in a spread condition;

placing a work tool in working relationship with the material in a work operation while the material is spread on the support surface;

identifying present working condition parameters which include type of sheet material, depth of sheet material or number of plies of sheet material;

inputting the present working condition parameters into a control system which includes a look-up table storing a plurality of predetermined pressure level values for holding the sheet material down on the support surface and the working condition parameters associated with the respective pressure level values;

matching the present working condition parameters with the stored working condition parameters to select a pressure level value for holding the sheet material down under the present working condition parameters;

retrieving the selected pressure level value; and applying pressure to the sheet material at the selected pressure level value to securely hold the sheet material to the support surface.

5. A method of working on sheet material as defined in claim 4, wherein the step of inputting is performed manually.

6. A method of working on sheet material as defined in claim 4, wherein the step of applying pressure includes adjustably energizing an actuator coupled to a presser plate for pressing the presser plate against the sheet material at the selected pressure level value.

* * * * *